US008628350B2

(12) United States Patent
Briant et al.

(10) Patent No.: US 8,628,350 B2
(45) Date of Patent: Jan. 14, 2014

(54) MULTIPLE COMMUNICATION PROTOCOL ELECTRICAL CONNECTOR ASSEMBLY

(75) Inventors: Eric David Briant, Dillsburg, PA (US); Scott Anthony Shuey, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 138 days.

(21) Appl. No.: 13/288,117

(22) Filed: Nov. 3, 2011

(65) Prior Publication Data

US 2013/0115824 A1 May 9, 2013

(51) Int. Cl.
*H01R 13/60* (2006.01)

(52) U.S. Cl.
USPC ..... 439/540.1; 439/680

(58) Field of Classification Search
USPC ..... 439/217, 218, 222, 223, 540.1, 541.5, 439/680–681
See application file for complete search history.

(56) References Cited

U.S. PATENT DOCUMENTS

| | | | | |
|---|---|---|---|---|
| 4,115,665 | A * | 9/1978 | Giacoppo et al. | 439/540.1 |
| 4,220,391 | A * | 9/1980 | Krolak et al. | 439/540.1 |
| 5,397,242 | A * | 3/1995 | Laisne et al. | 439/101 |
| 6,942,524 | B2 | 9/2005 | Wu | |
| 7,210,955 | B2 | 5/2007 | Ringler et al. | |
| 7,710,734 | B2 | 5/2010 | Ice et al. | |
| 7,833,068 | B2 | 11/2010 | Bright et al. | |
| 7,859,849 | B2 | 12/2010 | Ice | |
| 7,892,013 | B1 | 2/2011 | Piekos | |

* cited by examiner

*Primary Examiner* — Khiem Nguyen

(57) ABSTRACT

An electrical connector is configured to mate with at least one mating connector to electrically connect a first electrical component to a second electrical component. The electrical connector includes a first connector and a second connector housing. The first connector housing includes a plurality of first contacts. The first connector housing is associated with a first communication protocol. The second connector housing includes a plurality of second contacts, and is associated with a second communication protocol that is separate and distinct from the first communication protocol. The first and second connector housings are integrally connected to one another.

20 Claims, 8 Drawing Sheets

MULTIPLE COMMUNICATION PROTOCOL ELECTRICAL CONNECTOR ASSEMBLY

BACKGROUND

The subject matter herein relates generally to electrical connector assemblies that are adapted to be associated with multiple communication protocols.

Various communication or computing systems use electrical connectors for transmitting data signals between different components of the systems. For example, some electrical connectors may be configured to receive an edge of an electrical component having component contacts located therealong. The electrical connectors may include housing cavities having opposing rows of mating contacts. When the edge is advanced into the housing cavity of the electrical connector, the edge moves between the opposing rows of mating contacts. The component contacts electrically engage the mating contacts in the housing cavity.

Many communication and computing systems utilize different communication protocols. For example, one communication protocol may be used with respect to storage devices, while another communication protocol may be used with respect to expansion cards, for example. Separate and distinct connection interfaces are typically used with respect to each communication protocol. For example, a connection interface for a connector associated with one communication protocol may have contacts arranged in a particular pattern or configuration, while a connection interface for a connector associated with a different communication protocol may have contacts arranged in a different pattern or configuration. Therefore, a typical system may include multiple connector housings having distinct connection interfaces to accommodate the various communication protocols. However, the multiple connector housings take up valuable space within a computer system. Further, if a system is upgraded or changed so that the system uses a different communication protocol, the connector housings may need to be removed and replaced.

SUMMARY

Certain embodiments provide an electrical connector configured to mate with at least one mating connector to electrically connect a first electrical component to a second electrical component. The electrical connector may include first and second connector housings. The first connector housing includes a plurality of first contacts, and is associated with a first communication protocol. The second connector housing includes a plurality of second contacts, and is associated with a second communication protocol that is separate and distinct from the first communication protocol. The first and second connector housings are integrally connected to one another.

The electrical connector may include an intermediate joint connecting the first connector housing to the second connector housing. A center tower may be positioned between the first and second connector housings. The center tower is configured to align a first mating connector with the first connector housing, and a second mating connector with the second connector housing.

The first connector housing may include a first outer post, and the second connector housing may include a second outer post. The first and second outer posts are located at opposite ends from one another. The center tower and the first outer post are configured to align the first mating connector with the first connector housing. Similarly, the center tower and the second outer post are configured to align the second mating connector with the second connector housing.

The center tower may include an extension beam having a first shape at one side and a second shape at an opposite side. The first shape prevents the second mating connector from properly mating with the first connector housing. The second shape prevents the first mating connector from properly mating with the second connector housing. The first shape may be square or rectangular, and the second shape may be a rounded semi-circle. Alternatively, various other shapes may be used.

The first outer post may have a first shape, and the second outer post may have a second shape that is distinct from the first shape. The first shape prevents the second mating connector from properly mating with the first connector housing. The second shape prevents the first mating connector from properly mating with the second connector housing. The first shape may be square or rectangular, and the second shape may be a rounded semi-circle. Alternatively, various other shapes and sizes may be used.

One of the first and second connector housing may include at least one keying notch formed therein. The keying notch ensures proper mating with a compatible mating connector. The keying notch prevents improper mating with an incompatible mating connector.

The distinct shapes, formed keying notches, and the like are examples of keying members that ensure proper mating of the distinct mating connectors with connector housings, and prevent improper mating. Various other keying members, such as tabs, slots, and the like, located at different distances on different connector housings and mating connectors may be used.

The first communication protocol may be SAS, PCIe, InfiniBand, Fibre Channel, or SATA. The second communication protocol may be another of SAS, PCIe, InfiniBand, Fibre Channel, or SATA.

Certain embodiments provide a mating connector configured to mate with one of a first or second connector housing of an electrical connector. The mating connector may include a frame retaining a plurality of contacts, wherein the plurality of contacts are associated with a particular communication protocol, a tower-receiving member, and an outer post-receiving member. The tower-receiving member and the outer post-receiving member have distinctly-shaped passages that ensure that the mating connector properly mates with a connector housing associated with the particular communication protocol. The distinctly-shaped passages prevent the mating connector from mating with another connector housing associated with a different communication protocol.

One or both of the tower-receiving member and the outer post-receiving member may include a passage formed through a sleeve or collar. The passage may have a square or rectangular-shaped axial cross section. The passage may have a semi-circular-shaped axial cross section. However, various other shaped and sized axial cross-sections may be used.

Certain embodiments provide a connector assembly configured to electrically connect a first electrical component to another electrical component. The connector assembly includes a receptacle connector and first and second plug connectors.

The receptacle connector may include a first connector housing including a plurality of first receptacle contacts, wherein the first connector housing is associated with a first communication protocol, first keying members, a second connector housing including a plurality of second receptacle contacts, wherein the second connector housing is associated with a second communication protocol that is separate and distinct from the first communication protocol, wherein the first and second connector housings are integrally connected to one another, and second keying members.

The first plug connector is configured to mate with the first connector housing. The first plug connector includes a first frame retaining a plurality of first mating contacts, wherein the plurality of first mating contacts are associated with the first communication protocol. The first frame may include one or more first-shaped passages configured to mate with the first keying members to ensure that the first plug connector properly mates with the first connector housing associated with the first communication protocol, and prevent the first plug connector from mating with the second connector housing associated with the second communication protocol.

The second plug connector is configured to mate with the second connector housing. The second plug connector includes a second frame retaining a plurality of second mating contacts, wherein the plurality of second mating contacts are associated with the second communication protocol. The second frame includes one or more second-shaped passages configured to mate with the second keying members to ensure that the second plug connector properly mates with the second connector housing associated with the second communication protocol, and prevent the second plug connector from mating with the first connector housing associated with the first communication protocol.

The first keying members may include at least one first distinctly-shaped post, and the second keying members may include at least one second distinctly-shaped post that differs from the first distinctly-shaped post. One or both of the first and second keying members may include at least one keying notch formed in one of the first or second connector housings.

DETAILED DESCRIPTION

Figure 1:
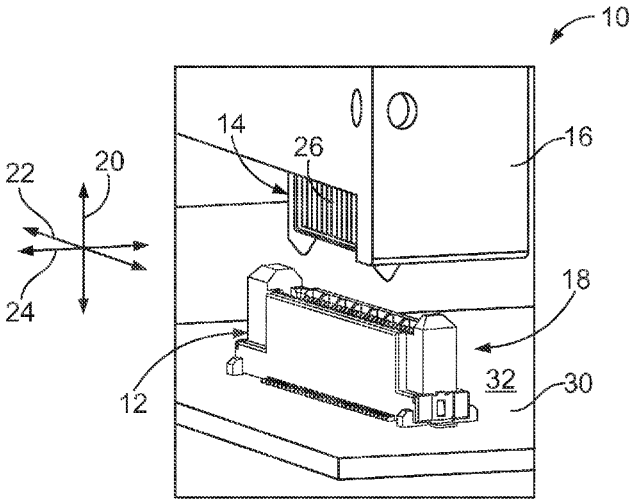
FIG. 1 illustrates a perspective view of a communication system according to an embodiment.

FIG. 1 illustrates a perspective view of a computer or communication system 10 according to an embodiment. The system 10 includes an electrical or receptacle connector 12 and a mating or plug connector 14.

Figure 2:
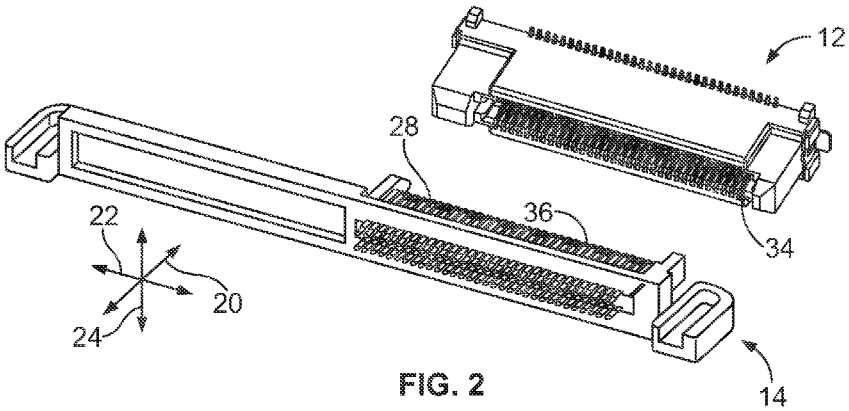
FIG. 2 illustrates a perspective view of an electrical or receptacle connector and a mating or plug connector according to an embodiment.

FIG. 2 illustrates a perspective view of the electrical connector 12 and the mating connector 14. Referring to FIGS. 1 and 2, the system 10 may include an electrical component 16 (FIG. 1) that includes the mating connector 14 and a receptacle assembly 18 (FIG. 1) that includes the electrical connector 12 and is configured to communicatively engage the electrical component 16. As shown, the system 10 and the electrical and mating connectors 12 and 14 are oriented with respect to mutually perpendicular axes 20, 22, and 24, including a mating axis 20, a longitudinal axis 22, and an orientation axis 24. The electrical component 16 includes a first row of component contacts 26 (FIG. 1) and a second row of component contacts 28 (FIG. 2). The first and second rows of component contacts 26 and 28 may be arranged parallel to each other along the longitudinal axis 22. The first row and the second row of component contacts 26 and 28 may face in opposite directions along the orientation axis 24.

As shown in FIG. 1, the receptacle assembly 18 may include a circuit board 30 that has a board surface 32 having a plurality of electrical contacts (not shown). The electrical contacts may be, for example, contact pads or plated through-holes. The electrical connector 12 is configured to be mounted to the board surface 32. As shown in FIG. 2, the electrical connector 12 has a component-receiving region 34 that is configured to receive the electrical component 16. More specifically, the component-receiving region 34 is configured to receive a mating end or edge 36 of the mating connector 14 that has the component contacts 26 and 28 located there-along. During a mating operation, the first and second rows of component contacts 26 and 28 are advanced in a mating direction along the mating axis 20 into the component-receiving region 34. The component contacts 26 and 28 are configured to electrically engage corresponding mating contacts (shown in FIG. 3) of the electrical connector 12 thereby communicatively coupling the circuit board 30 and the electrical component 16.

The electrical component 16 may be, for example, a solid state drive and the electrical connector 12 may be configured to communicatively couple to the solid state drive. However, in alternative embodiments, the electrical connector 12 may be an edge-to-edge or straddle-mount connector that receives and holds a circuit board. In the illustrated embodiment, the electrical connector 12 is a vertical connector because the component-receiving region 34 of the electrical connector 12 opens away from the board surface 32. However, in alternative embodiments, the electrical connector 12 may be a right-angle connector in which the component-receiving region 34 opens in a direction that is parallel to the plane of the board surface 32. The electrical connector 12 may have other geometries as well.

In some embodiments, the electrical connector 12 may be configured to enable transmission of high-speed data signals, such as data signals greater than about 10 gigabits/second (Gbs) or data signals greater than about 15 Gbs. In particular embodiments, the electrical connector 12 may be configured to enable transmission of data signals at speeds above 20 Gbs and up to about 24 Gbs or more.

Figure 3:
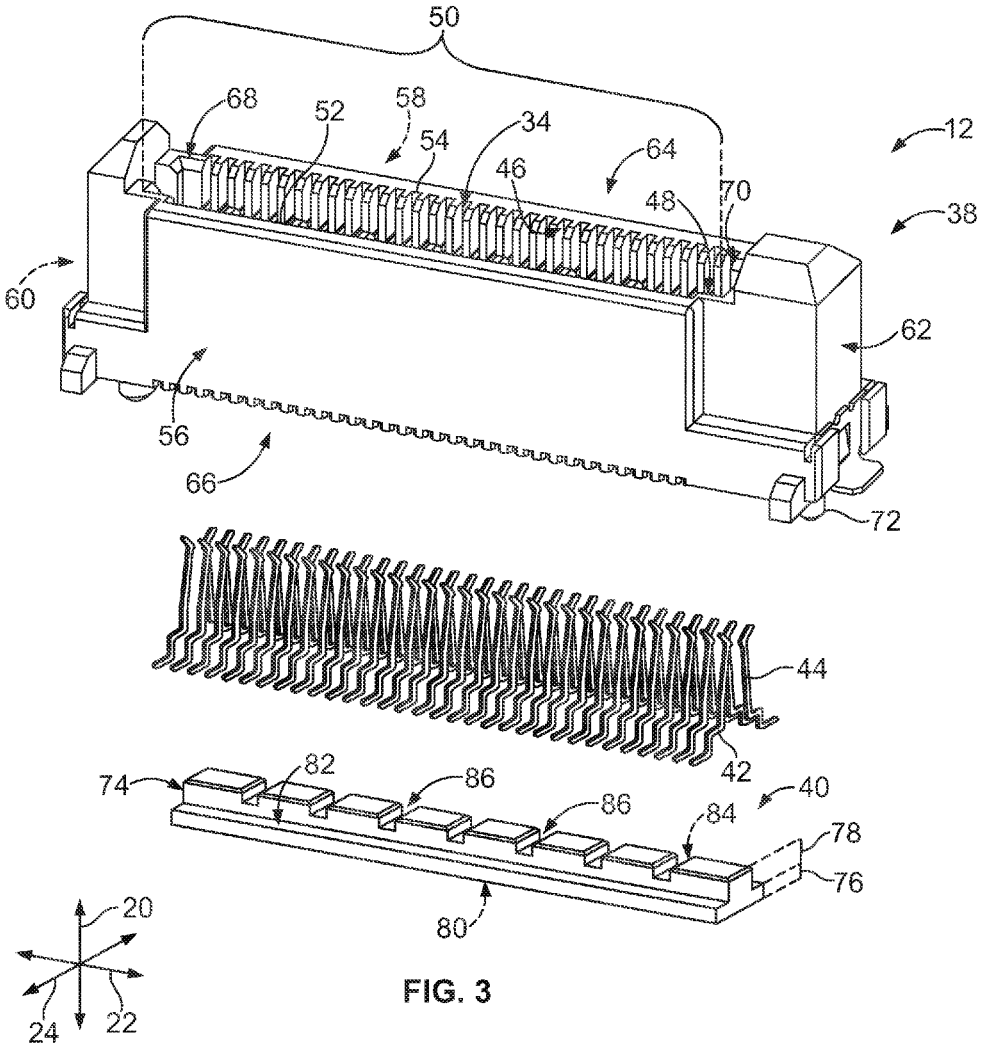
FIG. 3 illustrates an exploded view of an electrical or receptacle connector, according to an embodiment.

FIG. 3 illustrates an exploded view of the electrical connector 12, according to an embodiment. As shown, the electrical connector 12 may include a connector housing 38, a retention insert 40, and a plurality of mating contacts 42 and 44. The connector housing 38 may have interior walls 46 and 48 that oppose each other with a contact cavity 50 therebetween. The mating contacts 42 and 44 and the retention insert 40 are positioned within the contact cavity 50 when the electrical connector 12 is fully assembled. The contact cavity 50 includes the component-receiving region 34. The mating contacts 42 may be arranged in a first row, and the mating contacts 44 may be arranged in a second row that opposes the first row. When the electrical connector 12 is fully assembled, the first and second rows of mating contacts 42 and 44 are held between the connector housing 38 and the retention insert 40 within the contact cavity 50. For example, the first row of mating contacts 42 may be located within contact channels 52 of the interior wall 48 and held between the retention insert 40 and the interior wall 48. The second row of mating contacts 44 may be located within contact channels 54 of the interior wall 46 and held between the retention insert 40 and the interior wall 46. When the electrical connector 12 is assembled, the component-receiving region 34 exists between the first and second rows of mating contacts 42 and 44.

In the illustrated embodiment, the connector housing 38 is capable of independently holding the mating contacts 42 and 44 before the retention insert 40 is positioned within the contact cavity 50. However, in alternative embodiments, the retention insert 40 may be capable of independently holding the mating contacts 42 and 44 before the retention insert 40 is positioned within the connector housing 38. In another alternative embodiment, neither the connector housing 38 nor the retention insert 40 is capable of independently holding the mating contacts 42 and 44.

The connector housing 38 may have opposite housing sides 56 and 58 that extend along a plane that includes the mating axis 20 and the longitudinal axis 22. The housing sides 56 and 58 may face in generally opposite directions along the orientation axis 24. The connector housing 38 may also have opposite sidewalls 60 and 62 that extend along a plane that includes the mating axis 20 and the orientation axis 24. The sidewalls 60 and 62 may face in generally opposite directions along the longitudinal axis 22. In the illustrated embodiment, the connector housing 38 is substantially block-shaped. However, the connector housing 38 may have other geometries in alternative embodiments.

Also shown, the connector housing 38 may have opposite mating and loading faces 64 and 66. The mating axis 20 extends between the mating and loading faces 64 and 66, and the mating and loading faces 64 and 66 face in generally opposite directions along the mating axis 20. The loading face 66 is configured to be mounted to an electrical component, such as the circuit board 30 (FIG. 1). The loading face 66 may be mounted to the board surface 32 (FIG. 1). In alternative embodiments, such as when the electrical connector 12 is a right-angle connector, the mating and loading faces 64 and 66 may not face in generally opposite directions, but may face in directions that are substantially perpendicular to each other.

The connector housing 38 may include one or more alignment features, such as cavities, recesses, edges, posts, and the like that facilitate aligning the connector housing 38 with either or both of the electrical components (e.g., the electrical component 16 or the circuit board 30). Such alignment features may be configured to engage corresponding alignment features of the other electrical component. For example, the connector housing 38 may define one or more spatial regions 68 and 70 that are proximate to the component-receiving region 34. In the illustrated embodiment, the contact cavity 50 includes the component-receiving region 34 and the spatial regions 68 and 70 such that the component-receiving region 34 and the spatial regions 68 and 70 are portions of a common space. However, in alternative embodiments, the component-receiving region 34 may be separated from the spatial regions 68 and 70. The spatial regions 68 and 70 are sized and shaped to receive a corresponding alignment feature of the electrical component 16.

Also shown in FIG. 3, the loading face 66 may include one or more posts 72 that are configured to be inserted into holes (not shown) of the circuit board 30 to properly align the electrical connector 12. In alternative embodiments, the connector housing 38 may include posts or other projections that extend away from the mating face 64 to be received by corresponding spatial regions of the electrical component 16. Furthermore, in alternative embodiments, the loading face 66 may include spatial regions that are sized and shaped to receive posts that are attached to the circuit board 30.

The contact cavity 50 may be accessible through the mating face 64 and also through the loading face 66. For example, the mating contacts 42 and 44 and the retention insert 40 may be configured to be inserted into the contact cavity 50 through the loading face 66. In the illustrated embodiment, the contact cavity 50 may be completely or entirely surrounded by the connector housing 38 and opens in opposite directions along the mating axis 20. For example, the housing sides 56 and 58 and the sidewalls 60 and 62 completely surround the contact cavity 50. However, in alternative embodiments, the connector housing 38 may only surround a portion of the contact cavity 50. For instance, the connector housing 38 may only comprise the housing sides 56 and 58 and the sidewall 60. A gap may exist where the sidewall 62 is located in the illustrated embodiment. Instead, the retention insert 40 may be sized and shaped to fill in the gap.

The retention insert 40 is sized and shaped to be advanced through the loading face 66 and positioned within the contact cavity 50. The retention insert 40 extends lengthwise along the longitudinal axis 22 when positioned within the connector housing 38. As shown, the retention insert 40 includes an outer engagement surface 74. In the illustrated embodiment, the engagement surface 74 directly engages the mating contacts 42 and 44 and interfaces with the connector housing 38.

As shown, the retention insert 40 may include a platform portion 76 and a cavity portion 78. The engagement surface 74 may extend along both of the platform and cavity portions 76 and 78. The platform portion 76 may have an insert side 80 that faces in an opposite direction with respect to the engagement surface 74. The insert side 80 may form a portion of the loading face 66 when the retention insert 40 is positioned within the contact cavity 50. The platform portion 76 may include shoulder sections 82 and 84 that are separated by the cavity portion 78. The shoulder sections 82 and 84 may face in a direction along the mating axis 20 toward the mating face 64. At least a portion of the shoulder sections 82 and 84 may extend along a plane that is substantially perpendicular to the mating axis 20. As such, the retention insert 40 may be substantially T-shaped. Also shown, the cavity portion 78 may extend along the platform portion 76 and include a plurality of recesses 86.

Figure 4:
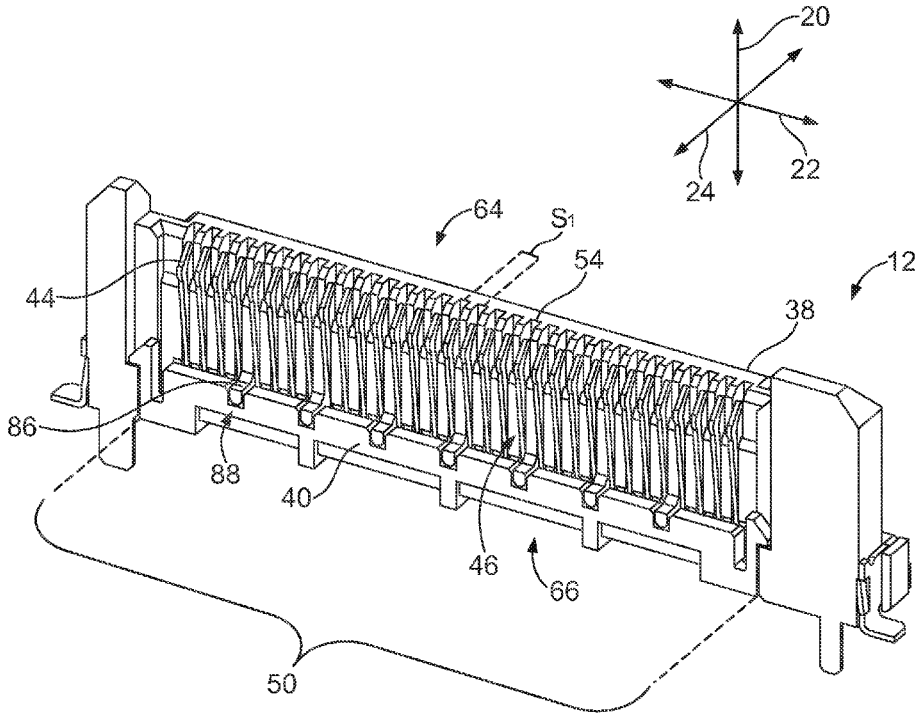
FIG. 4 illustrates a cross-section of an electrical or receptacle connector, according to an embodiment.

FIG. 4 illustrates a cross-section of the electrical connector 12. Although FIG. 4 only illustrates one half of the exemplary contact cavity 50, the opposite half may include similar features. As shown, the interior wall 46 may be shaped to define a plurality of the contact channels 54. The contact channels 54 may be distributed along a length of the interior wall 46 parallel to the longitudinal axis 22. The contact channels 54 extend parallel to the mating axis 20. Adjacent contact channels 54 may be separated from each other by a centerline spacing $S_1$. Also shown, the connector housing 38 may include bridge supports 88 that extend parallel to the orientation axis 24 between the interior wall 48 (FIG. 3) and the interior wall 46. The bridge supports 88 mechanically join the interior walls 46 and 48 and are configured to prevent the interior walls 46 and 48 from separating when the retention insert 40 is moved between the first and second rows of mating contacts 42 (FIG. 3) and 44. As shown, the bridge supports 88 are spaced apart from each other along the length of the interior wall 46.

When the electrical connector 12 is assembled, the mating contacts 44 are inserted into corresponding contact channels 54. The mating contacts 44 form the first row when located within the contact channels 54. In the illustrated embodiment, the mating contacts 44 are inserted through the loading face 66, but may be inserted through the mating face 64 in other embodiments. The mating contacts 44 may be held by the connector housing 38 within the contact channels 54. For example, the connector housing 38 may form an interference fit with each of the mating contacts 44. In the exemplary embodiment, after the mating contacts 44 are located within the corresponding contact channels 54, the retention insert 40 may be advanced through the loading face 66 along the mating axis 20. The recesses 86 are configured to receive the bridge supports 88 when the retention insert 40 is advanced therein. The bridge supports 88 and the retention insert 40 may form a substantially flush surface.

Figure 5:
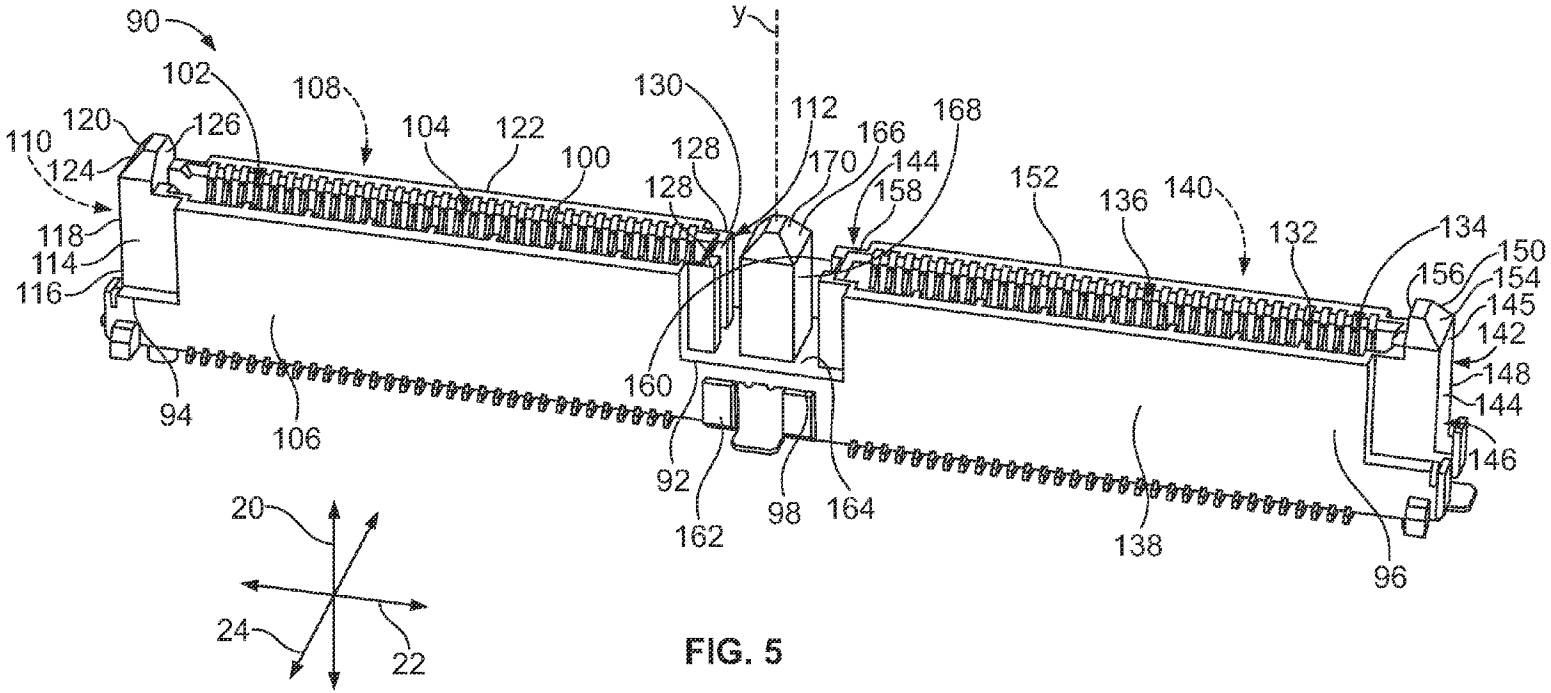
FIG. 5 illustrates a perspective view of an electrical or receptacle connector, according to an embodiment.

FIG. 5 illustrates a perspective view of an electrical or receptacle connector 90, according to an embodiment. The electrical connector 90 includes a base 92 that supports a first connector housing 94 and a second connector housing 96 integrally connected to one another by an intermediate joint 98. That is, the first connector housing 92, the second connector housing 96, and the intermediate joint 98 form a single, unitary construction that may be formed from a single mold, for example. Each of the first and second connector housings 94 and 96 may be configured in a similar manner as the connector housing 38, shown and described with respect to FIGS. 1-4.

The first connector housing 94 includes mating contacts 100 within a contact cavity 102. The contact cavity 102 includes a component-receiving region 104. The connector housing 94 includes housing sides 106 and 108 that extend along a plane that includes the mating axis 20 and the longitudinal axis 22. The connector housing 94 also includes sidewalls 110 and 112 that extend along a plane that includes the mating axis 20 and the orientation axis 24. In the illustrated embodiment, the connector housing 94 is substantially block-shaped. However, the connector housing 94 may have other geometries in alternative embodiments.

The outer sidewall 110 includes an upstanding post 114 at an outer end 116. The post 114 includes a generally rectangular extension beam 118 and a partially beveled tip 120 that extends above a plane defined by top edges 122 of the sides 106 and 108. The outer portion 124 of the tip 120 is beveled, while an interior portion 126 is generally flat. Alternatively, the post 114 may be fully-beveled, or fully block-shaped.

The interior sidewall 112 may include upstanding beams 128 separated by a vertical channel 130. As shown in FIG. 5, the top edges of the beams 128 are generally in the same plane as the top edges 122 of the sides 106 and 108.

Similarly, the second connector housing 96 includes mating contacts 132 within a contact cavity 134. The contact cavity 134 includes a component-receiving region 136. The connector housing 96 includes housing sides 138 and 140 that extend along a plane that includes the mating axis 20 and the longitudinal axis 22. The connector housing 96 also includes sidewalls 142 and 144 that extend along a plane that includes the mating axis 20 and the orientation axis 24. In the illustrated embodiment, the connector housing 96 is substantially block-shaped. However, the connector housing 96 may have other geometries in alternative embodiments.

The outer sidewall 142 includes an upstanding post 145 at an outer end 146. The post 145 includes a generally rectangular extension beam 148 and a partially beveled tip 150 that extends above a plane defined by top edges 152 of the sides 138 and 140. The outer portion 154 of the tip 150 is beveled, while an interior portion 156 is generally flat. Alternatively, the post 145 may be fully-beveled, or fully block-shaped.

The interior sidewall 144 may include upstanding beams 158 separated by a vertical channel 160. As shown in FIG. 5, the top edges of the beams 158 are generally in the same plane as the top edges 152 of the sides 138 and 140.

As noted, the base 92 includes the intermediate joint 98 that integrally connects the first connector housing 94 to the second connector housing 96. The intermediate joint 98 is located at a center of the electrical connector 90 between the first and second connector housings 94 and 96. The electrical connector 90 includes the two separate and distinct connector housings 94 and 96 integrally formed and connected with one another through the intermediate joint 98.

The intermediate joint 98 includes opposed sides 162 that integrally connect to the first and second housings 94 and 96. A ledge 164 integrally connects to the sides 162 and is generally perpendicular to the sides 162. A center tower 166 extends from the ledge 164 about a lateral axis y of the electrical connector 90. The center tower 166 includes an extension beam 168 having a fully-beveled tip 170 extending therefrom. The beveled tip 170 extends to a level that is generally in the same plane as the tips 120 and 150. As shown, the center tower 166 is positioned between, and spaced apart from, the interior sidewalls 112 and 144. The center tower 166 is configured to properly align mating connectors (shown in FIGS. 6-9) with respective component-receiving regions 104 and 136. Separate and distinct mating connectors are both configured to utilize the center tower 166. Optionally, instead of a single center tower 166, two separate and distinct inboard towers may be used. However, the single center tower 166 efficiently utilizes limited space, and provides a compact electrical connector. Moreover, the single center tower 166 prevents two plugs from being connected at the same time, which may be desirable if a system is to communicate using one protocol at a particular time.

The component-receiving region 104 of the first connector housing 94 provides an interface associated with a first communication protocol. Similarly, the component-receiving region 136 of the second connector housing 96 provides an interface associated with a second communication protocol that differs from the first communication protocol. A communication protocol is an electronic language that a computing or communication system uses to communicate with different parts of the system. An interface associated with a first communication protocol is arranged and configured differently from an interface associated with a second communication protocol. Each interface includes a distinct pattern of contacts, such as signal contacts, ground contacts, differential pairs, and the like, arranged in a distinct pattern, configuration, or the like, that is associated with a particular communication protocol. For example, an interface associated with a SAS communication protocol differs from an interface associated with a PCIe communication protocol. Optionally, the component-receiving regions 104 and 136 may both be configured to provide communication over the same communication protocol, thereby allowing a larger number of contacts of a particular communication protocol to be used within a communication or computing system.

Examples of communication protocols include Serial Attached Small Computer System Interface (SAS), Peripheral Component Interconnect (PCIe), Fibre Channel, InfiniBand, Serial Advance Technology Attachment (SATA), and the like. SAS is a communication protocol used with respect to data storage and delivery to and from computer storage devices such as hard drives and tape drives. PCIe is a computer expansion card communication protocol. Fibre Channel is a communication protocol used for storage networking. InfiniBand is a communication protocol used for a switched fabric link used in high performance computing. SATA is a communication protocol for connecting host bus adapters to mass storage devices, such as hard disk drives and optical drives. As noted, the first housing connector 94 provides an interface associated with one communication protocol, while the second housing connector 96 provides an interface associated with another communication protocol, which is separate and distinct from the first communication protocol. For example, the first housing connector 94 may be a SAS connector, while the second housing connector 96 may be a PCIe connector.

Figure 6:
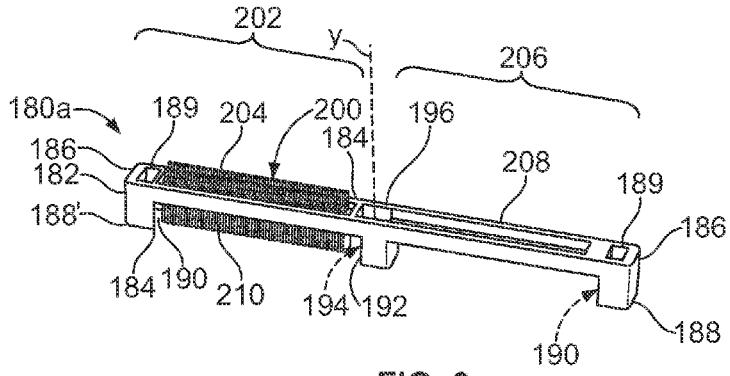
FIG. 6 illustrates a perspective view of a mating or plug connector, according to an embodiment.

FIG. 6 illustrates a perspective view of a mating or plug connector 180*a*, according to an embodiment. The mating connector 180*a* includes a frame 182 having opposed sides 184 integrally formed and connected with opposed ends 186. Each opposed end 186 includes an outer collar 188. Each collar 188 defines a central axial passage 189 and inboard open portion 190. The collars 188 are configured to be positioned around outer portions of the posts 114 and 144.

Figure 7:
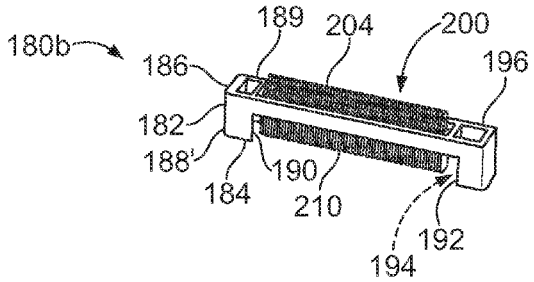
FIG. 7 illustrates a perspective view of a mating or plug connector, according to an embodiment.

The mating connector 180*a* also includes a central collar 192 centered about a lateral axis y of the mating connector 180*a*. The central collar 192 includes an open portion 194 that faces the inboard open portion 190 of the collar 188', which, as shown in FIG. 7, is to the left of the central collar 192. A central axial passage 196 is formed through the collar 192. The central axial passage 196 is shaped and sized to fit around three outer sides of the center tower 166 of the electrical connector 90 (FIG. 5).

A contact receptacle area 200 is formed in a first side 202 of the mating connector 180*a*. The contact receptacle area 200 includes a plurality of contacts 204 compatible with the first communication protocol, and configured to mate into the component-receiving region 104 of the electrical connector 90. The second side 206 of the mating connector 180*a* includes a blocking section 208 that does not include contacts.

Referring to FIGS. 5 and 6, in order to mate the mating connector 180*a* with the electrical connector 90, the mating connector 180*a* is positioned over the electrical connector 90 such that the contact receptacle area 200 is aligned with the component-receiving region 104. The central collar 192 is aligned over the center tower 166, and the left outer collar 188' is aligned over the post 114. The mating connector 180*a* is then urged toward the electrical connector 90 such that the lower ends 210 of the contacts 204 pass into the component-receiving region 104 and mate with the contacts 122. At this time, the collar 192 secures over and around the center tower 166, while the outer collar 188' secures over and around the post 114. Thus, the mating connector 180*a* is properly mated with the electrical connector 90 and is associated with the first communication protocol.

FIG. 7 illustrates a perspective view of a mating or plug connector 180*b*, according to an embodiment. The mating connector 180*b* is similar to the mating connector 180*a* shown in FIG. 6, except that the mating connector 180*b* does not include the second side 206. Thus, the mating connector 180*b* does not include a blocking section or an outer collar 188 to the right of the central collar 192.

Figure 8:
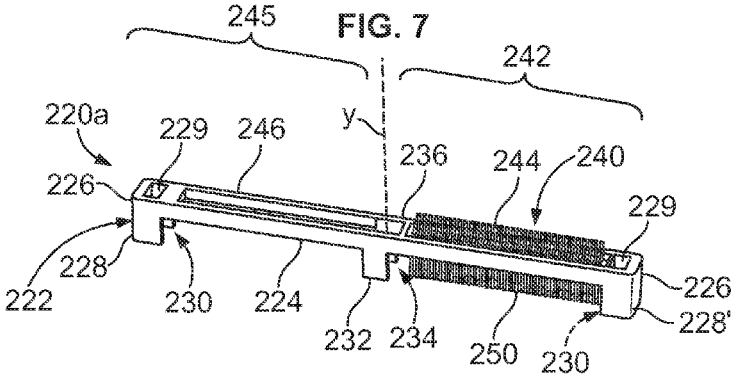
FIG. 8 illustrates a perspective view of a mating or plug connector, according to an embodiment.

FIG. 8 illustrates a perspective view of a mating or plug connector 220*a*, according to an embodiment. The mating connector 220*a* includes a frame 222 having opposed sides 224 integrally formed and connected with opposed ends 226. Each opposed end 226 includes an outer collar 228. Each collar 228 defines an axial passage 229 and inboard open portion 230. The collars 228 are configured to be positioned around outer portions of the posts 114 and 144.

The mating connector 220*a* also includes a central collar 232 centered about a lateral axis y of the mating connector 220*a*. The central collar 232 includes an open portion 234 that faces the inboard open portion 230 of the collar 228', which, as shown in FIG. 8, is to the right of the central collar 232. A central axial passage 236 is formed through the collar 232. The central axial passage 236 is shaped and sized to fit around the center tower 166 of the electrical connector 90 (FIG. 5).

A contact receptacle area 240 is formed through a second side 242 of the mating connector 220*a*. The contact receptacle area 240 includes a plurality of contacts 244 compatible with the second communication protocol, and configured to mate into the component-receiving region 136 of the electrical connector 90. The first side 245 of the mating connector 220*a* includes a blocking section 246 that does not include contacts.

Referring to FIGS. 5 and 8, in order to mate the mating connector 220*a* with the electrical connector 90, the mating connector 220*a* is positioned over the electrical connector 90 such that the contact receptacle area 240 is aligned with the component-receiving region 136. The central collar 232 is aligned over the center tower 166, and the right outer collar 228' is aligned over the post 145. The mating connector 220*a* is then urged toward the electrical connector 90 such that the lower ends 250 of the contacts 244 pass into the component-receiving region 136. At this time, the collar 232 secures over and around three outer sides of the center tower 166, while the outer collar 228' secures over and around the post 145. Thus, the mating connector 220*a* is properly mated with the electrical connector 90 and is associated with the second communication protocol, which differs from the first communication protocol.

Figure 9:
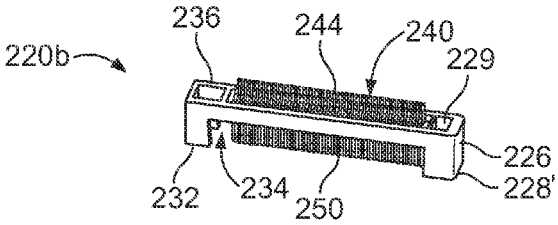
FIG. 9 illustrates a perspective view of a mating or plug connector, according to an embodiment.

FIG. 9 illustrates a perspective view of a mating connector 220*b*, according to an embodiment. The mating connector 220*b* is similar to the mating connector 220*a* shown in FIG. 8, except that the mating connector 220*b* does not include the second side 245. Thus, the mating connector 220*b* does not include a blocking section or an outer collar 228 to the left of the central collar 232.

Figure 10:
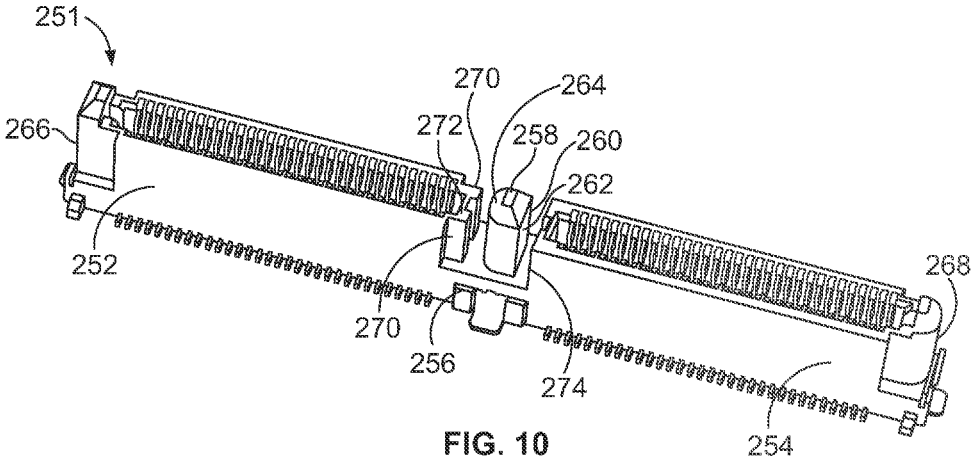
FIG. 10 illustrates a perspective view of an electrical or receptacle connector, according to an embodiment.

FIG. 10 illustrates a perspective view of an electrical or receptacle connector 251, according to an embodiment. The electrical connector 251 is similar to the electrical connector 90 shown in FIG. 5, except that the electrical connector 251 includes keying members, such as distinctly-shaped posts, keying notches, distinctly-spaced tabs, slots, and the like, that ensure that a particular mating connector mates with a proper connector housing, and prevents the particular mating connector from mating with an incompatible connector housing.

The electrical connector 251 includes a first connector housing 252 and a second connector housing 254 integrally connected through an intermediate joint 256. As shown in FIG. 10, a center tower 258 extends upwardly from the intermediate joint 256, as discussed above with respect to FIG. 5. However, the center tower 258 includes an extension beam 260 having a flat keying wall 262 proximate the second connector housing 254, and a rounded keying wall 264 proximate the first connector housing 252. Additionally, an outer post 266 of the first connector housing 252 is flat, while an outer post 268 of the second connector housing 254 is round. Further, right angled keying notches 270 are formed at ends of the interior end wall 272 of the first connector housing 252, while no such keying notches are formed on an interior end wall 274 of the second connector housing 254. Instead of keying notches, keying ridges, detents, protuberances, barbs, clasps, or the like may be used.

Figure 11:
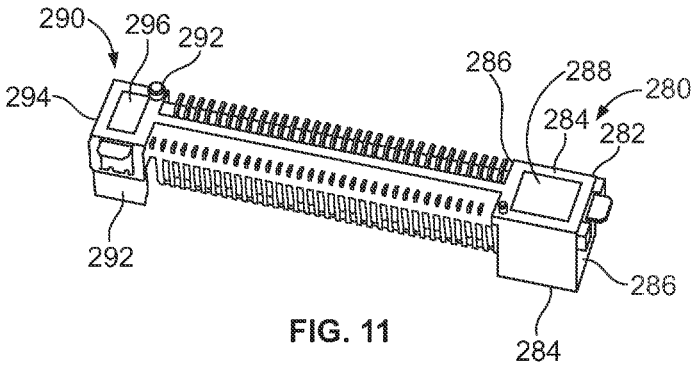
FIG. 11 illustrates a perspective view of a mating or plug connector, according to an embodiment.

FIG. 11 illustrates a perspective view of a mating connector 280, according to an embodiment. The mating connector 280 is associated with a first communication protocol. The mating connector 280 is similar to the mating connectors described with respect to FIGS. 6 and 7, except that the mating connector 280 includes a tower-receiving sleeve 282 having opposed side walls 284 and an end wall 286 that define a square-shaped, flat-sided axial passage 288. Additionally, an outer post-receiving sleeve 290 that is distally located from the tower-receiving sleeve 282 includes opposed side walls 292 and an end wall 294 that define a rectangular, flat-sided axial passage 296. The mating connector 280 is configured to mate with the first connector housing 252 shown in FIG. 10 and is associated with the first communication protocol.

Figure 12:
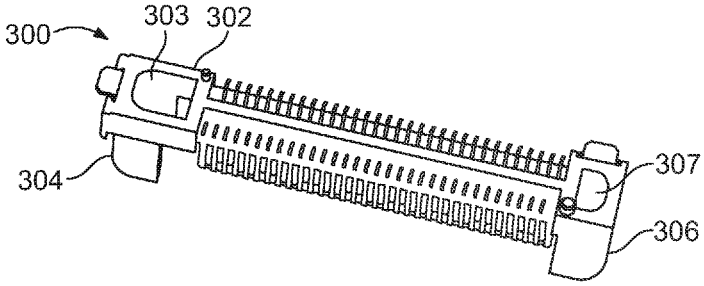
FIG. 12 illustrates a perspective view of a mating or plug connector, according to an embodiment.

FIG. 12 illustrates a perspective view of a mating connector 300, according to an embodiment. The mating connector 300 is associated with a second communication protocol, which differs from the first communication protocol. The mating connector 300 is similar to the mating connectors described with respect to FIGS. 8 and 9, except that the mating connector 300 includes a tower-receiving collar 302 having a rounded, curved wall 304 that conforms to the shape of the rounded wall 264 of the center tower 260. Additionally, an outer post-receiving sleeve 306 that is distally located from the tower-receiving collar 302 includes a semi-circular axial passage 307 that conforms to the shape and size of the outer post 268 of the second connector housing 254. The mating connector 300 is configured to mate with the second connector housing 254 shown in FIG. 10 and to communicate over the second communication protocol.

Figure 13:
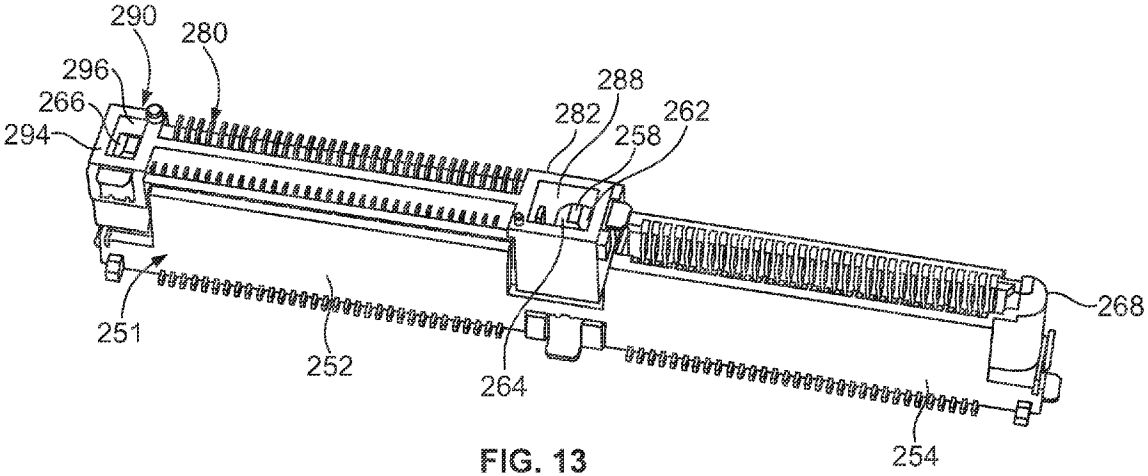
FIG. 13 illustrates a perspective view of a mating or plug connector properly mated with an electrical or receptacle connector, according to an embodiment.

FIG. 13 illustrates a perspective view of the mating connector 280 properly mated with the electrical connector 251, according to an embodiment. As shown in FIG. 13, the tower-receiving sleeve 282 receives the center tower 258. The flat-sided axial passage 288 conforms to the flat keying wall 262, while the rounded wall 264 of the center tower 258 is contained within the passage 288 proximate an opposite side. The keying notches 270 allow edges of the side walls 284 to nestle therein. Similarly, the outer post-receiving sleeve 290 retains the rectangular cross-section outer post 266 within the reciprocal flat-sided axial passage 296. In this manner, the keying members including the keying notches 270 and flat-sided passages receive reciprocal keying members of the mating connector 280 to ensure that the mating connector 280 only mates with the first connector housing 252. However, various other keying members, such as distinctly sized and shaped tabs, slots, barbs, clasps, or the like, may be used.

Figure 14:
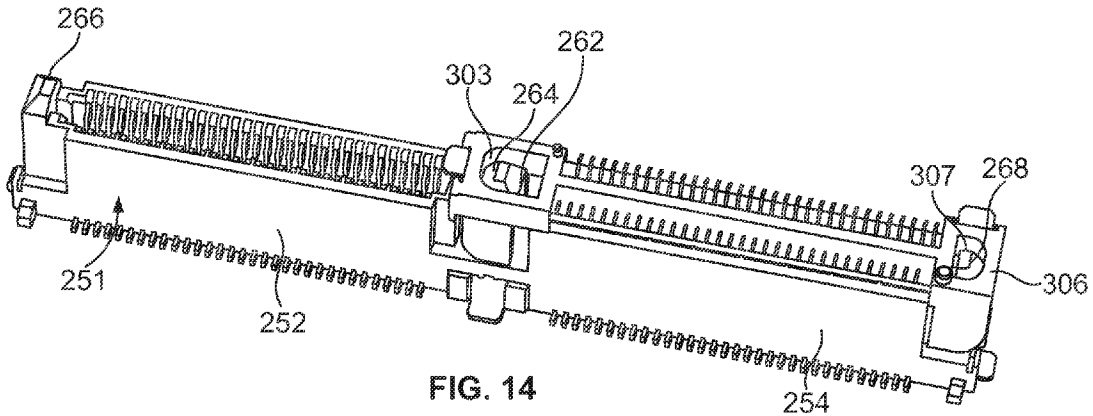
FIG. 14 illustrates a perspective view of a mating or plug connector properly mated with an electrical or receptacle connector, according to an embodiment.

FIG. 14 illustrates a perspective view of the mating connector 300 properly mated with the electrical connector 251, according to an embodiment. As shown in FIG. 14, the tower-receiving collar 302 receives the center tower 258. The rounded axial passage 303 conforms to the rounded keying wall 264, while the flat wall 262 of the center tower 258 is contained within the passage 303 at an opposite side. Similarly, the outer post-receiving sleeve 306 retains the semi-circular cross-section outer post 268 within the reciprocal rounded axial passage 307. In this manner, the keying members including the rounded passages receive reciprocal keying members of the mating connector 300 to ensure that the mating connector 300 only mates with the second connector housing 254. However, various other keying members, such as distinctly sized and shaped tabs, slots, barbs, clasps, or the like, may be used.

Figure 15:
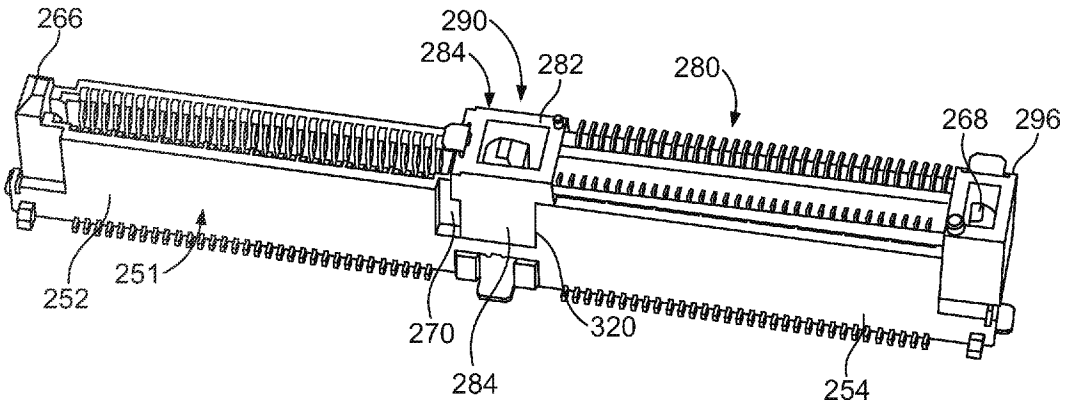
FIG. 15 illustrates a perspective view of a mating or plug connector improperly mated with an electrical or receptacle connector, according to an embodiment.

FIG. 15 illustrates a perspective view of the mating connector 280 improperly mated with the first connector housing 252, according to an embodiment. When the mating connector 280 is flipped around in an attempt to mate the mating connector 280 with the second connector housing 254 so that the outer post-receiving sleeve 290 is positioned on the outer post 268, the rounded shape of the outer post 268 may not allow the flat, rectangular axial passage 296 to slide fully over. Similarly, the long side walls 284 abut into walls 320 of the second connector housing 254. The long side walls 284 are accommodated by the keying notches 270 formed in the first connector housing 252, but interfere with the walls 320 of the second connector housing 254. Therefore, the distinct shape and size of the outer post-receiving sleeve 290 and the tower-receiving sleeve 282, and the interference with the walls 320 prevent the mating connector 280 from being mated with the second connector housing 254. As such, a mating connector 280 associated with a first communication protocol is prevented from being mated into a second connector housing 254 associated with a second communication protocol. A mating connection is prevented due to interference between the mating connector 280 and the second connector housing 254 due to shape miss-matches, as explained above.

Figure 16:
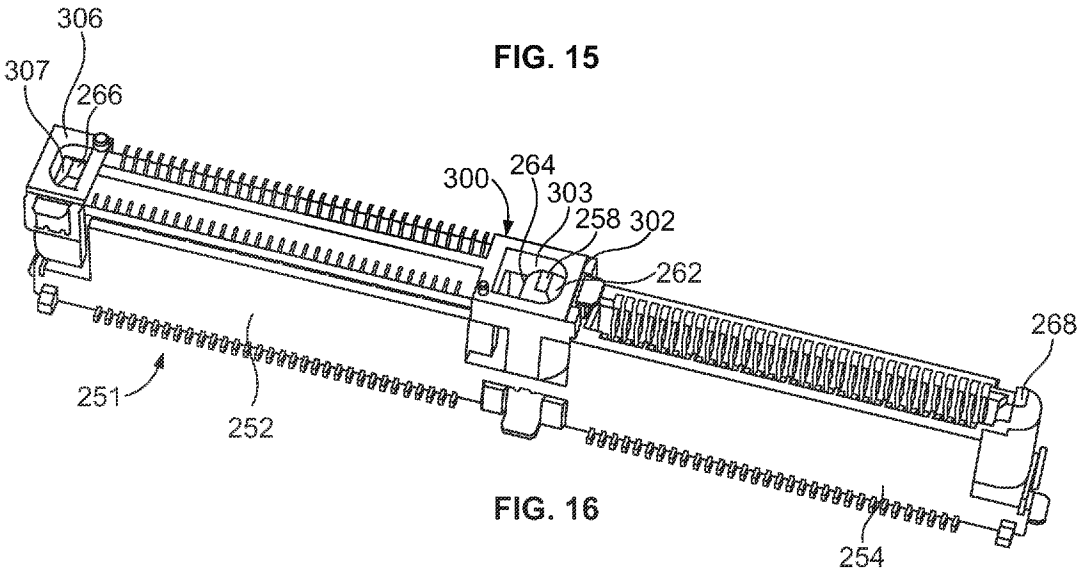
FIG. 16 illustrates a perspective view of a mating or plug connector improperly mated with an electrical or receptacle connector, according to an embodiment.

FIG. 16 illustrates a perspective view of the mating connector 300 improperly mated with the electrical connector 251, according to an embodiment. When the mating connector 300 is flipped around in an attempt to mate the mating connector 300 with the first connector housing 252 so that the outer post-receiving sleeve 306 is positioned on the outer post flat, rectangular shaped outer post 266, the rectangular shape of the outer post 266 is not able to fit into the rounded, semi-circular passage 307. Similarly, the rounded, semi-circular passage 303 is unable to accommodate the flat, rectangular wall 262. A square shape does not fit into a rounded opening because the length of the mating connector 300 ensures that flat edges of the wall 262 extend past a clearance area of the passage 303. Therefore, the distinct shape and size of the outer post-receiving sleeve 307 and the tower-receiving sleeve 302 prevent the mating connector 300 from being mated with the first connector housing 252. As such, a mating connector 300 associated with a second communication protocol is prevented from being mated into a first connector housing 252 associated with a first communication protocol. A mating connection is prevented due to interference between the mating connector 300 and the first connector housing 252 due to shape miss-matches, as explained above.

While the mating connectors 280 and 300 are shown having distinct shapes and sizes, the configurations may be reversed, such that the mating connector 280 has rounded passages and the like, while the mating connector 300 has flat, rectangular passages and the like. Further, the configuration and shapes of the connector housings 252 and 254 of the electrical connector 251 may be changed accordingly.

While certain keying members are shown as square, rectangular, and curved, semi-circular shapes, the keying members may be various shapes and sizes. For example, one set of keying members may be triangular, while another may be trapezoidal. Also, the keying members may include one or more tabs that fit into reciprocal slots at different distances. For example, a tab of a first connector housing may fit into a slot at a certain distance, while a tab of a second connector housing may fit into a slot at a different distance. If improper mating is attempted, the tabs and slots would not align.

Thus, embodiments provide a connector assembly that includes separate and distinct connector housings each configured to mate with reciprocal mating connectors. Further, each connector housing and reciprocal mating connector pair is associated with a distinct communication protocol that differs from the other pair. Optionally, both housings may be associated with the same communication protocol to accommodate a larger number of contacts for a particular system.

For example, a connector housing may include a first connector housing having four lanes of contacts associated with a first communication protocol, and a second connector housing that accommodates four lanes of contacts associated with a second communication protocol. A lane includes two contact pairs. A contact pair includes two signal contacts and two ground contacts. A single lane includes eight contacts. Four lanes ("4X") includes thirty-two contacts. Optionally, a connector housing may include first and second connector housings that each accommodate four lanes of contacts associated with the same communication protocol, thereby yielding eight lanes ("8X") associated with a single communication protocol.

Embodiments provide a connector assembly that is adaptable, interchangeable, and is able to accommodate changing needs of system manufacturers. Embodiments provide a connector assembly that accommodates multiple communication protocols so that if a component of a system utilizes a different communication protocol, the connector assembly is able to change along with the component (for example, instead of using one connector housing, the other connector housing may be used). Moreover, more connector housings may be used than those shown. For example, a connector assembly may include three or more connector housings, each associated with a different communication protocol.

Embodiments of the present invention provide a single connector assembly that allows a system to use two or more completely different and unrelated communication protocols.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope.

While various spatial and directional terms, such as top, bottom, lower, mid, lateral, horizontal, vertical, front and the like may be used to describe embodiments, it is understood that such terms are merely used with respect to the orientations shown in the drawings. The orientations may be inverted, rotated, or otherwise changed, such that an upper portion is a lower portion, and vice versa, horizontal becomes vertical, and the like.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector configured to mate with at least one mating connector to electrically connect a first electrical component to a second electrical component, the electrical connector comprising:

a first connector housing including a plurality of first contacts, wherein the first connector housing is associated with a first communication protocol;

a second connector housing including a plurality of second contacts, wherein the second connector housing is associated with a second communication protocol that is separate and distinct from the first communication protocol, and wherein the first and second connector housings are integrally connected to one another; and a center tower positioned between the first and second connector housings, wherein the center tower is configured to align a first mating connector with the first connector housing, and a second mating connector with the second connector housing.

2. The electrical connector of claim 1, further comprising an intermediate joint connecting the first connector housing to the second connector housing.

3. The electrical connector of claim 1, wherein the first connector housing comprises a first outer post, and the second connector housing comprises a second outer post, wherein the first and second outer posts are located at opposite ends from one another, and wherein the center tower and the first outer post are configured to align the first mating connector with the first connector housing, and wherein the center tower and the second outer post are configured to align the second mating connector with the second connector housing.

4. The electrical connector of claim 1, wherein the center tower includes an extension beam having a first shape at one side and a second shape at an opposite side, wherein the first shape prevents the second mating connector from properly mating with the first connector housing, and wherein the second shape prevents the first mating connector from properly mating with the second connector housing.

5. The electrical connector of claim 4, wherein the first shape is square or rectangular, and wherein the second shape is a rounded semi-circle.

6. The electrical connector of claim 3, wherein the first outer post has a first shape, and the second outer post has a second shape that is distinct from the first shape, wherein the first shape prevents the second mating connector from properly mating with the first connector housing, and wherein the second shape prevents the first mating connector from properly mating with the second connector housing.

7. The electrical connector of claim 6, wherein the first shape is square or rectangular, and wherein the second shape is a rounded semi-circle.

8. The electrical connector of claim 1, wherein one of the first and second connector housing comprises at least one keying notch formed therein, wherein the at least one keying notch ensures proper mating with a compatible mating connector, and wherein the at least one keying notch prevents improper mating with an incompatible mating connector.

9. The electrical connector of claim 1, wherein the first communication protocol is one of SAS, PCIe, InfiniBand, Fibre Channel, or SATA, and wherein the second communication protocol is another of SAS, PCIe, InfiniBand, Fibre Channel, or SATA.

10. An electrical connector configured to mate with at least one mating connector to electrically connect a first electrical component to a second electrical component, the electrical connector comprising:

a first connector housing including a plurality of first contacts, wherein the first connector housing is associated with a first communication protocol; and a second connector housing including a plurality of second contacts, wherein the second connector housing is associated with a second communication protocol that is separate and distinct from the first communication protocol, and wherein the first and second connector housings are integrally connected to one another, wherein one of the first and second connector housing comprises at least one keying notch formed therein, wherein the at least one keying notch ensures proper mating with a compatible mating connector, and wherein the at least one keying notch prevents improper mating with an incompatible mating connector.

11. The electrical connector of claim 10, wherein the first connector housing comprises a first outer post, and the second connector housing comprises a second outer post, wherein the first and second outer posts are located at opposite ends from one another, and wherein a center tower and the first outer post are configured to align the first mating connector with the first connector housing, and wherein the center tower and the second outer post are configured to align the second mating connector with the second connector housing.

12. The electrical connector of claim 10, further comprising a center tower positioned between the first and second connector housings, wherein the center tower is configured to align a first mating connector with the first connector housing, and a second mating connector with the second connector housing wherein the center tower includes an extension beam having a first shape at one side and a second shape at an opposite side, wherein the first shape prevents the second mating connector from properly mating with the first connector housing, and wherein the second shape prevents the first mating connector from properly mating with the second connector housing.

13. The electrical connector of claim 12, wherein the first shape is square or rectangular, and wherein the second shape is a rounded semi-circle.

14. The electrical connector of claim 11, wherein the first outer post has a first shape, and the second outer post has a second shape that is distinct from the first shape, wherein the first shape prevents the second mating connector from properly mating with the first connector housing, and wherein the second shape prevents the first mating connector from properly mating with the second connector housing.

15. The electrical connector of claim 14, wherein the first shape is square or rectangular, and wherein the second shape is a rounded semi-circle.

16. The electrical connector of claim 14, wherein the first communication protocol is one of SAS, PCIe, InfiniBand, Fibre Channel, or SATA, and wherein the second communication protocol is another of SAS, PCIe, InfiniBand, Fibre Channel, or SATA.

17. An electrical connector configured to mate with at least one mating connector to electrically connect a first electrical component to a second electrical component, the electrical connector comprising:

a first connector housing including a plurality of first contacts, wherein the first connector housing is associated with a first communication protocol; and a second connector housing including a plurality of second contacts, wherein the second connector housing is associated with a second communication protocol that is separate and distinct from the first communication protocol, and wherein the first and second connector housings are integrally connected to one another, wherein the first communication protocol is one of SAS, PCI; InfiniBand, Fibre Channel, or SATA, and wherein the second communication protocol is another of SAS, PCIe, InfiniBand, Fibre Channel, or SATA.

18. The electrical connector of claim 17, wherein the first connector housing comprises a first outer post, and the second connector housing comprises a second outer post, wherein the first and second outer posts are located at opposite ends from one another, and wherein a center tower and the first outer post are configured to align the first mating connector with the first connector housing, and wherein the center tower and the second outer post are configured to align the second mating connector with the second connector housing.

19. The electrical connector of claim 10, further comprising a center tower positioned between the first and second connector housings, wherein the center tower is configured to align a first mating connector with the first connector housing, and a second mating connector with the second connector housing wherein the center tower includes an extension beam having a first shape at one side and a second shape at an opposite side, wherein the first shape prevents the second mating connector from properly mating with the first connector housing, and wherein the second shape prevents the first mating connector from properly mating with the second connector housing.

20. The electrical connector of claim 18, wherein the first outer post has a first shape, and the second outer post has a second shape that is distinct from the first shape, wherein the first shape prevents the second mating connector from properly mating with the first connector housing, and wherein the second shape prevents the first mating connector from properly mating with the second connector housing.

* * * * *